US011533952B2

(12) United States Patent
Florack et al.

(10) Patent No.: US 11,533,952 B2
(45) Date of Patent: Dec. 27, 2022

(54) AEROSOL-GENERATING SYSTEM WITH VENTILATION AIRFLOW

(71) Applicant: Philip Morris Products S.A., Neuchatel (CH)

(72) Inventors: Dionisius Elisabeth Antonius Florack, Le Landeron (CH); Ali Murat Saygili, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 409 days.

(21) Appl. No.: 16/627,922

(22) PCT Filed: Jul. 13, 2018

(86) PCT No.: PCT/EP2018/069180
§ 371 (c)(1),
(2) Date: Dec. 31, 2019

(87) PCT Pub. No.: WO2019/012151
PCT Pub. Date: Jan. 17, 2019

(65) Prior Publication Data

US 2021/0145051 A1 May 20, 2021

(30) Foreign Application Priority Data

Jul. 14, 2017 (EP) ..... 17181537

(51) Int. Cl.
*A24F 40/485* (2020.01)
*A24F 40/48* (2020.01)
(Continued)

(52) U.S. Cl.
CPC ..... *A24F 40/485* (2020.01); *A24F 40/48* (2020.01); *A24F 40/20* (2020.01); *A24F 40/30* (2020.01); *A24F 40/42* (2020.01)

(58) Field of Classification Search
CPC ..... A24F 40/485; A24F 40/48; A24F 40/40; A24F 40/10
See application file for complete search history.

(56) References Cited

U.S. PATENT DOCUMENTS 11,229,235 B2 * 1/2022 Saygili ..... A24F 40/42
2014/0261492 A1 * 9/2014 Kane ..... A24F 40/42 131/328

(Continued)

FOREIGN PATENT DOCUMENTS

CA 2 974 364 7/2016
CN 105307520 A 2/2016

(Continued)

OTHER PUBLICATIONS

Combined Russian Office Action and Search Report dated Nov. 3, 2021 in corresponding Russian Patent Application No. 2020106718/03(010429) (with English Translation) citing documents AO-AQ therein, 18 pages.

(Continued)

*Primary Examiner* — Hae Moon Hyeon
(74) *Attorney, Agent, or Firm* — Oblon, McClelland, Maier & Neustadt, L.L.P.

(57) ABSTRACT

An aerosol-generating system is provided, including: a cartridge assembly including an outer housing defining a mouthpiece having an air outlet, a cartridge having upstream and downstream ends and including first and second compartments, a mixing chamber extending between a downstream end of the cartridge and the mouthpiece air outlet, and a ventilation air inlet downstream of the cartridge; and an aerosol-generating device including a device inner housing defining a device cavity, an electrical heater configured to heat the cartridge, a power supply, a controller configured to control a supply of electrical power to the electric heater, and a device outer housing, such that when the upstream end (Continued)

of the cartridge is received within the device cavity, a first part of a downstream edge of the device outer housing abuts a first part of an upstream edge of the cartridge assembly outer housing to form a system outer housing.

13 Claims, 4 Drawing Sheets

(51) Int. Cl.

| | |
|---|---|
| *A24F 40/20* | (2020.01) |
| *A24F 40/30* | (2020.01) |
| *A24F 40/42* | (2020.01) |

(56) References Cited

U.S. PATENT DOCUMENTS

| | | | | |
|---|---|---|---|---|
| 2014/0314397 | A1 | 10/2014 | Alima | |
| 2015/0196060 | A1 | 7/2015 | Wensley et al. | |
| 2016/0262454 | A1 | 9/2016 | Sears et al. | |
| 2017/0095002 | A1 | 4/2017 | Silvestrini | |
| 2018/0228216 | A1 | 8/2018 | Saygili | |
| 2020/0163376 | A1* | 5/2020 | Saygili | A61M 15/06 |
| 2020/0221777 | A1* | 7/2020 | Saygili | A24F 40/57 |

FOREIGN PATENT DOCUMENTS

| | | | |
|---|---|---|---|
| CN | 106455720 | A | 2/2017 |
| EP | 2 319 334 | A1 | 5/2011 |
| JP | 2017-500847 | | 1/2017 |
| RU | 2014 127 684 | A | 2/2016 |
| WO | WO 2010/145894 | A1 | 12/2010 |
| WO | WO 2013/083635 | A1 | 6/2013 |
| WO | WO 2015/042412 | A1 | 3/2015 |
| WO | WO 2015/197627 | A1 | 12/2015 |
| WO | WO 2017/032695 | A1 | 3/2017 |
| WO | 2017/108983 | A1 | 6/2017 |
| WO | WO 2017/108721 | A1 | 6/2017 |
| WO | WO 2017/129615 | A1 | 8/2017 |
| WO | WO 2017/129616 | A1 | 8/2017 |
| WO | WO 2018/099999 | A1 | 6/2018 |
| WO | WO 2019/011937 | A1 | 1/2019 |

OTHER PUBLICATIONS

Extended European Search Report dated Jan. 25, 2018, in Patent Application No. 17181537.6, 7 pages.

International Search Report and Written Opinion dated Oct. 18, 2018 in PCT/EP2018/069180 filed Jul. 13, 2018.

Japanese Office Action dated Aug. 17, 2022 in corresponding Japanese Patent Application No. 2019-571426 w/English-language Translation, citing documents 1, 15, and 16, therein, 11 pages.

Office Action dated Oct. 19, 2022, issued in corresponding Chinese patent application No. 201880041314.2 (with English translation) citing documents 15-17.

* cited by examiner

AEROSOL-GENERATING SYSTEM WITH VENTILATION AIRFLOW

CROSS-REFERENCE TO RELATED APPLICATIONS

This application is a U.S. national stage application of PCT/EP2018/069180, filed on Jul. 13, 2018, which is based upon and claims the benefit of priority under 35 U.S.C. § 119 to European application no. 17181537.6, filed Jul. 14, 2017, the entire contents of each of which are incorporated herein by reference.

TECHNICAL FIELD

The present invention relates to an aerosol-generating system comprising a cartridge assembly and configured for ventilation airflow into the cartridge assembly. Particularly preferred embodiments of the invention relate to an aerosol-generating system comprising a nicotine source and an acid source for the in situ generation of an aerosol comprising nicotine salt particles.

DESCRIPTION OF THE RELATED ART

Devices for generating and delivering aerosols to a user are known, including devices for delivering nicotine to a user. Known systems for delivering aerosols to a user may include one or more inlets for introducing ventilation air into the device. In this context, ventilation air is airflow that passes through the system in a manner that bypasses the aerosol-generating section of the system. Therefore, ventilation air dilutes the mainstream airflow containing the generated aerosol to provide a desired concentration of aerosol to the user.

However, typically, known devices have included ventilation air inlets without considering the effect of ventilation air on the quality of the aerosol delivered to a user and how positioning ventilation air inlets may affect the performance of the device. It would be desirable to provide an aerosol-generating system that addresses at least these issues with known devices.

SUMMARY

According to the present invention there is provided an aerosol-generating system comprising a cartridge assembly and an aerosol-generating device. The cartridge assembly comprises a cartridge assembly outer housing at least partially defining a mouthpiece having a mouthpiece air outlet. The cartridge assembly further comprises a cartridge at least partially positioned within the cartridge assembly outer housing and having an upstream end and a downstream end. The cartridge comprises a first compartment having a first air inlet at the upstream end of the cartridge and a first air outlet at the downstream end of the cartridge, and a second compartment having a second air inlet at the upstream end of the cartridge and a second air outlet at the downstream end of the cartridge. The cartridge assembly also comprises a mixing chamber extending between the downstream end of the cartridge and the mouthpiece air outlet, and a ventilation air inlet. The ventilation air inlet extends through the cartridge assembly outer housing and is positioned downstream of the cartridge, the ventilation air inlet providing fluid communication between an exterior of the aerosol-generating system and the mixing chamber. The aerosol-generating device comprises a device inner housing defining a device cavity for receiving an upstream end of the cartridge and an electrical heater for heating the cartridge when the upstream end of the cartridge is received within the device cavity. The aerosol-generating device further comprises a power supply, a controller configured to control a supply of electrical power from the power supply to the electric heater, and a device outer housing. When the upstream end of the cartridge is received within the device cavity, at least a first part of a downstream edge of the device outer housing abuts at least a first part of an upstream edge of the cartridge assembly outer housing so that the cartridge assembly outer housing and the device outer housing form a system outer housing.

BRIEF DESCRIPTION OF THE DRAWINGS

The invention will be further described, by way of example only, with reference to the accompanying drawings in which.

DETAILED DESCRIPTION

Figure 1:
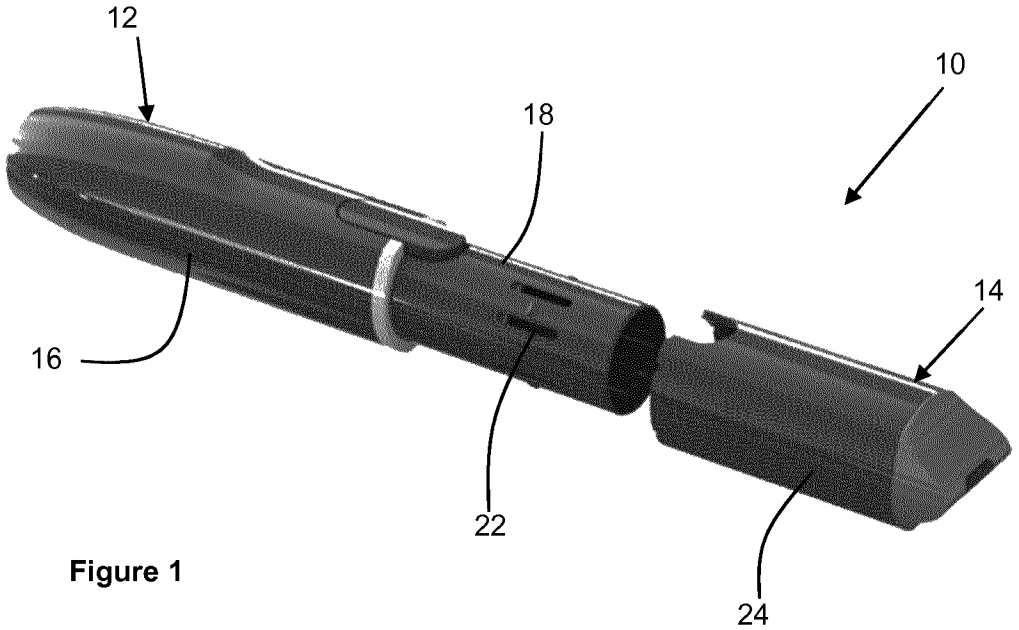
FIG. 1 shows a perspective view of an aerosol-generating system according to a first embodiment of the present invention.

As used herein, the terms "upstream" and "downstream" refer to the direction of airflow through the cartridge assembly or components of the cartridge assembly during use of the aerosol-generating system. That is, generally, air flows from an upstream end to a downstream end.

Aerosol-generating systems according to the present invention comprise a ventilation air inlet in a cartridge assembly, wherein the ventilation air inlet is positioned downstream of a cartridge. The present inventors have recognised that this configuration is particularly advantageous when compared to known aerosol-generating systems. In particular, positioning the ventilation air inlet downstream of the cartridge substantially eliminates contact between the ventilation air and the cartridge, which is heated during use. Advantageously, this reduces the temperature of the ventilation air when compared to known systems in which ventilation air enters the system upstream of the cartridge or adjacent to the cartridge and flows across an outer surface of the cartridge before being mixed with mainstream air further downstream. Reducing the temperature of the ventilation air may reduce the overall temperature of the aerosol delivered to a user, which may improve the user experience. Reducing the temperature of the ventilation air may facilitate an increase in a heating temperature of the cartridge while maintaining an overall temperature of the aerosol delivered to a user.

Advantageously, aerosol-generating systems according to the present invention comprise a cartridge assembly having an outer housing that forms part of the system outer housing, which may facilitate grasping of the cartridge assembly by a user. This is in contrast to known systems in which a cylindrical article or cartridge is received almost entirely within a cavity of a device.

At least a first part of a downstream edge of a device outer housing abuts at least a first part of an upstream edge of the cartridge assembly outer housing when the upstream end of the cartridge is received within the device cavity. Advantageously, this may facilitate connection of the cartridge assembly with the device cavity by a user. When the first part of the downstream edge of the device outer housing abuts the first part of the upstream edge of the cartridge assembly outer housing, the user knows that the upstream end of the cartridge has been fully inserted into the device cavity. When the first part of the downstream edge of the device outer housing abuts the first part of the upstream edge of the cartridge assembly outer housing, further insertion of the upstream end of the cartridge into the device cavity is prevented.

The aerosol-generating system may be configured so that at least a portion of the device inner housing is received between the cartridge and the cartridge assembly outer housing when the upstream end of the cartridge is received within the device cavity.

Advantageously, this may facilitate correct alignment of the cartridge assembly with the aerosol-generating device.

Advantageously, this may facilitate a secure connection between the cartridge assembly and the aerosol-generating device. For example, the aerosol-generating system may be configured so that the at least a portion of the device inner housing is received between the cartridge and the cartridge assembly outer housing by an interference fit.

The cartridge assembly may comprise a cartridge holder, wherein at least a portion of the cartridge is positioned within the cartridge holder, and wherein at least a portion of the cartridge holder is positioned within the cartridge assembly outer housing.

Advantageously, the cartridge holder may reduce conductive heat transfer from the cartridge to the cartridge assembly outer housing during use of the aerosol-generating system. This may further reduce or minimise the temperature of ventilation air entering the mixing chamber through the ventilation air inlet.

The cartridge holder may have a tubular shape. Preferably, at least the downstream end of the cartridge is positioned within the cartridge holder. Preferably, at least a downstream end of the cartridge holder is positioned within the mouthpiece. Preferably, the tubular cartridge holder comprises an open upstream end through which the cartridge is inserted into the tubular cartridge holder during manufacture of the cartridge assembly. Preferably, the tubular cartridge holder comprises an open downstream end to provide fluid communication between the first and second air outlets of the cartridge and the mixing chamber.

The aerosol-generating system may be configured so that at least a portion of the device inner housing is received between the cartridge holder and the cartridge assembly outer housing when the upstream end of the cartridge is received within the device cavity.

Advantageously, this may facilitate correct alignment of the cartridge assembly with the aerosol-generating device.

Advantageously, this may facilitate a secure connection between the cartridge assembly and the aerosol-generating device. For example, the aerosol-generating system may be configured so that the at least a portion of the device inner housing is received between the cartridge holder and the cartridge assembly outer housing by an interference fit.

A downstream end of the cartridge holder may be positioned upstream of the ventilation air inlet. Advantageously, this may eliminate the need for one or more apertures in the cartridge holder to provide fluid communication between the ventilation air inlet and the mixing chamber.

A portion of the cartridge holder may overlap a portion of the cartridge assembly outer housing comprising the ventilation air inlet, wherein the cartridge holder comprises a ventilation air aperture underlying the ventilation air inlet to provide fluid communication between the ventilation air inlet and the mixing chamber. Advantageously, this configuration may increase or maximise the overlap between the cartridge holder and the cartridge assembly outer housing, which may facilitate securing the cartridge assembly outer housing and the cartridge holder together.

Preferably, the aerosol-generating system further comprises a system airflow inlet extending through the system outer housing, the system airflow inlet providing fluid communication between the exterior of the aerosol-generating system and an upstream end of the device cavity, wherein the system airflow inlet is separate from the ventilation air inlet. The system airflow inlet provides mainstream airflow to the first and second air inlets of the cartridge.

The aerosol-generating system may be configured so that, when the first part of the downstream edge of the device outer housing abuts the first part of the upstream edge of the cartridge assembly outer housing, a second part of the downstream edge of the device outer housing is spaced apart from a second part of the upstream edge of the cartridge assembly outer housing to define the system airflow inlet between the second part of the downstream edge of the device outer housing and the second part of the upstream edge of the cartridge assembly outer housing.

The aerosol-generating device may comprise a device air inlet extending through the device inner housing, the device air inlet providing fluid communication between the system airflow inlet and an upstream end of the device cavity.

Preferably, an upstream portion of the cartridge assembly outer housing is spaced apart from the device inner housing to form a first airflow channel extending between the system airflow inlet and the device air inlet.

A portion of the device inner housing may be spaced apart from a surface of the cartridge to form a second airflow channel extending between the device air inlet and the upstream end of the device cavity.

Preferably, the device air inlet is positioned adjacent to the cartridge so that at least a portion of the second airflow channel extends parallel with the cartridge. Advantageously, this configuration may facilitate pre-heating of the air entering the cartridge by passing the airflow across the surface of the heated cartridge as the airflow moves through the second airflow channel.

The system airflow inlet may extend through the device outer housing. Advantageously, this arrangement may simplify the construction of the aerosol-generating system by simplifying the flow of air into the cartridge. Preferably, an upstream end of the system airflow inlet is in direct fluid communication with the exterior of the aerosol-generating system and a downstream end of the system airflow inlet is in direct fluid communication with the upstream end of the device cavity.

The cartridge assembly may comprise a single ventilation air inlet. The cartridge assembly may comprise a plurality of ventilation air inlets. The skilled person can select the number of ventilation air inlets to provide a desired flow of ventilation air into the mixing chamber during use of the aerosol-generating system.

Preferably, the first compartment contains a first aerosol-forming substrate and the second compartment contains a second aerosol-forming substrate.

Preferably, the first compartment contains a nicotine source and the second compartment contains an acid source. As described herein, the configuration of aerosol-generating systems according to the present invention may facilitate a reduction in the temperature of ventilation air entering the mixing chamber. The present inventors have recognised that this is particularly advantageous in embodiments in which the cartridge comprises a nicotine source and an acid source, wherein nicotine and acid vapours are mixed in the mixing chamber to form nicotine salt particles for delivery to a user. In particular, the present inventors have recognised that reducing the temperature of the ventilation air entering the mixing chamber reduces the mean size of the nicotine salt particles formed within the mixing chamber, which advantageously reduces the harshness of the aerosol perceived by a user. Specifically, mixing ventilation air entering the mixing chamber at a temperature of below 50 degrees Celsius with nicotine and acid vapours both entering the mixing chamber at a temperature of approximately 80 degrees Celsius results in a significant reduction in nicotine salt particles having a diameter of over 2 micrometres, which yields the reduction in perceived harshness.

The nicotine source may comprise a first carrier material impregnated with between about 1 milligram and about 50 milligrams of nicotine. The nicotine source may comprise a first carrier material impregnated with between about 1 milligram and about 40 milligrams of nicotine. Preferably, the nicotine source comprises a first carrier material impregnated with between about 3 milligrams and about 30 milligrams of nicotine. More preferably, the nicotine source comprises a first carrier material impregnated with between about 6 milligrams and about 20 milligrams of nicotine. Most preferably, the nicotine source comprises a first carrier material impregnated with between about 8 milligrams and about 18 milligrams of nicotine.

The first carrier material may be impregnated with liquid nicotine or a solution of nicotine in an aqueous or non-aqueous solvent.

The first carrier material may be impregnated with natural nicotine or synthetic nicotine.

The acid source may comprise an organic acid or an inorganic acid.

Preferably, the acid source comprises an organic acid, more preferably a carboxylic acid, most preferably an alpha-keto or 2-oxo acid or lactic acid.

Advantageously, the acid source comprises an acid selected from the group consisting of 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid, lactic acid and combinations thereof. Advantageously, the acid source comprises pyruvic acid or lactic acid. More advantageously, the acid source comprises lactic acid.

Advantageously, the acid source comprises a second carrier material impregnated with acid.

The first carrier material and the second carrier material may be the same or different.

Advantageously, the first carrier material and the second carrier material have a density of between about 0.1 grams/cubic centimetre and about 0.3 grams/cubic centimetre.

Advantageously, the first carrier material and the second carrier material have a porosity of between about 15 percent and about 55 percent.

The first carrier material and the second carrier material may comprise one or more of glass, cellulose, ceramic, stainless steel, aluminium, polyethylene (PE), polypropylene, polyethylene terephthalate (PET), poly(cyclohexanedimethylene terephthalate) (PCT), polybutylene terephthalate (PBT), polytetrafluoroethylene (PTFE), expanded polytetrafluoroethylene (ePTFE), and BAREX®.

The first carrier material acts as a reservoir for the nicotine.

Advantageously, the first carrier material is chemically inert with respect to nicotine.

The first carrier material may have any suitable shape and size. For example, the first carrier material may be in the form of a sheet or plug.

Advantageously, the shape and size of the first carrier material is similar to the shape and size of the first compartment of the cartridge.

The shape, size, density and porosity of the first carrier material may be chosen to allow the first carrier material to be impregnated with a desired amount of nicotine.

Advantageously, the first compartment of the cartridge may further comprise a flavourant. Suitable flavourants include, but are not limited to, menthol.

Advantageously, the first carrier material may be impregnated with between about 3 milligrams and about 12 milligrams of flavourant.

The second carrier material acts as a reservoir for the acid.

Advantageously, the second carrier material is chemically inert with respect to the acid.

The second carrier material may have any suitable shape and size. For example, the second carrier material may be in the form of a sheet or plug.

Advantageously, the shape and size of the second carrier material is similar to the shape and size of the second compartment of the cartridge.

The shape, size, density and porosity of the second carrier material may be chosen to allow the second carrier material to be impregnated with a desired amount of acid.

Advantageously, acid source is a lactic acid source comprising a second carrier material impregnated with between about 2 milligrams and about 60 milligrams of lactic acid.

Preferably, the lactic acid source comprises a second carrier material impregnated with between about 5 milligrams and about 50 milligrams of lactic acid. More preferably, the lactic acid source comprises a second carrier material impregnated with between about 8 milligrams and about 40 milligrams of lactic acid. Most preferably, the lactic acid source comprises a second carrier material impregnated with between about 10 milligrams and about 30 milligrams of lactic acid.

The shape and dimensions of the first compartment of the cartridge may be chosen to allow a desired amount of nicotine to be housed in the cartridge.

The shape and dimensions of the second compartment of the cartridge may be chosen to allow a desired amount of acid to be housed in the cartridge.

The ratio of nicotine and acid required to achieve an appropriate reaction stoichiometry may be controlled and balanced through variation of the volume of the first compartment relative to the volume of the second compartment.

The first air inlet of the first compartment of the cartridge and the second air inlet of the second compartment of the cartridge may each comprise one or more apertures. For example, the first air inlet of the first compartment of the cartridge and the second air inlet of the second compartment of the cartridge may each comprise one, two, three, four, five, six or seven apertures.

The first air inlet of the first compartment of the cartridge and the second air inlet of the second compartment of the cartridge may comprise the same or different numbers of apertures.

Advantageously, the first air inlet and the second air inlet each comprise a plurality of apertures. For example, the first air inlet and the second air inlet may each comprise two, three, four, five, six or seven apertures.

Providing a first air inlet comprising a plurality of apertures and a second air inlet comprising a plurality of apertures may advantageously result in more homogeneous airflow within the first compartment and the second compartment, respectively. In use, this may improve entrainment of nicotine in an air stream drawn through the first compartment and improve entrainment of acid in an air stream drawn through the second compartment.

The ratio of nicotine and acid required to achieve an appropriate reaction stoichiometry may be controlled and balanced through variation of the volumetric airflow through the first compartment relative to the volumetric airflow through the second compartment. The ratio of the volumetric airflow through the first compartment relative to the volumetric airflow through the second compartment may be controlled through variation of one or more of the number, dimensions and location of the apertures forming the first air inlet of the first compartment relative to the number, dimensions and location of the apertures forming the second air inlet of the second compartment.

In embodiments in which the acid source comprises lactic acid, advantageously the flow area of the second air inlet of the second compartment is greater than the flow area of the first air inlet of the first compartment.

As used herein with reference to the invention, the term "flow area" is used to describe the cross-sectional area of an air inlet or air outlet through which air flows during use. In embodiments in which an air inlet or air outlet comprises a plurality of apertures, the flow area of the air inlet or air outlet is the total flow area of the air inlet or air outlet and is equal to the sum of the flow areas of each of the plurality of apertures forming the air inlet or air outlet. In embodiments in which the cross-sectional area of an air inlet or air outlet varies in the direction of airflow, the flow area of the air inlet or air outlet is the minimum cross-sectional area in the direction of airflow.

The first air outlet of the first compartment of the cartridge and the second air outlet of the second compartment of the cartridge may each comprise one or more apertures. For example, the first air outlet and the second air outlet may each comprise one, two, three, four, five, six or seven apertures.

The first air outlet and the second air outlet may comprise the same or different numbers of apertures.

Advantageously, the first air outlet and the second air outlet may each comprise a plurality of apertures. For example, the first air outlet and the second air outlet may each comprise two, three, four, five, six or seven apertures. Providing a first air outlet comprising a plurality of apertures and a second air outlet comprising a plurality of apertures may advantageously result in more homogeneous airflow within the first compartment and the second compartment, respectively. In use, this may improve entrainment of nicotine in an air stream drawn through the first compartment and improve entrainment of acid in an air stream drawn through the second compartment.

In embodiments in which the first air outlet comprises a plurality of apertures, advantageously the first air outlet comprises between 2 and 5 apertures.

In embodiments in which the second air outlet comprises a plurality of apertures, advantageously, the second air outlet comprises between 3 and 7 apertures.

Advantageously, the first air outlet and the second air outlet may each comprise a single aperture, which may advantageously simplify manufacturing of the cartridge.

The ratio of nicotine and acid required to achieve an appropriate reaction stoichiometry may be controlled and balanced through variation of the volumetric airflow through the first compartment relative to the volumetric airflow through the second compartment. The ratio of the volumetric airflow through the first compartment relative to the volumetric airflow through the second compartment may be controlled through variation of one or more of the number, dimensions and location of the apertures forming the first air outlet relative to the number, dimensions and location of the apertures forming the second air outlet.

The flow area of the first air outlet may be the same as or different to the flow area of the second air outlet.

The flow area of the second air outlet may be greater than flow area of the first air outlet.

Increasing the flow area of the second air outlet relative to the flow area of the first air outlet may advantageously increase the volumetric airflow through the second air outlet compared to the volumetric airflow through the first air outlet.

The cartridge assembly may comprise one or more aerosol-modifying agents positioned within the mouthpiece. For example, the mouthpiece may contain one or more sorbents, one or more flavourants, one or more chemesthetic agents or a combination thereof.

The cartridge, the cartridge assembly outer housing, and the cartridge holder where present may be formed from any suitable material or combination of materials. Suitable materials include, but are not limited to, aluminium, polyether ether ketone (PEEK), polyimides, such as Kapton®, polyethylene terephthalate (PET), polyethylene (PE), high-density polyethylene (HDPE), polypropylene (PP), polystyrene (PS), fluorinated ethylene propylene (FEP), polytetrafluoroethylene (PTFE), polyoxymethylene (POM), epoxy resins, polyurethane resins, vinyl resins, liquid crystal polymers (LCP) and modified LCPs, such as LCPs with graphite or glass fibres.

The cartridge, the cartridge assembly outer housing, and the cartridge holder where present may be formed from the same or different materials.

The cartridge may be formed from one or more materials that are nicotine-resistant and acid-resistant.

The first compartment may be coated with one or more nicotine-resistant materials and the second compartment may be coated with one or more acid-resistant materials.

Examples of suitable nicotine-resistant materials and acid-resistant materials include, but are not limited to, polyethylene (PE), polypropylene (PP), polystyrene (PS), fluorinated ethylene propylene (FEP), polytetrafluoroethylene (PTFE), epoxy resins, polyurethane resins, vinyl resins and combinations thereof.

Use of one or more nicotine-resistant materials may advantageously enhance the shelf life of the cartridge assembly.

Use of one or more acid-resistant materials may advantageously enhance the shelf life of the cartridge assembly.

Preferably, the aerosol-generating system is configured so that, during use, the electric heater heats the first compartment and the second compartment to between about 60 degrees Celsius and about 100 degrees Celsius, more preferably between about 70 degrees Celsius and about 90 degrees Celsius, most preferably about 80 degrees Celsius.

Preferably, the aerosol-generating system is configured so that, during use, ventilation air enters the mixing chamber through the ventilation air inlet at a temperature of less than about 50 degrees Celsius. Preferably, the ventilation air enters the mixing chamber through the ventilation air inlet at substantially ambient temperature.

The electric heater may comprise a resistive heater. The resistive heater may extend into the device cavity from an upstream end of the device cavity. Preferably, the cartridge comprises a third compartment positioned between the first compartment and the second compartment, wherein the third compartment is configured to receive the resistive heater when the upstream end of the cartridge assembly is received within the device cavity. During use, the controller controls the supply of electrical power from the power supply to the resistive heater to heat the first compartment and the second compartment.

The electric heater may comprise an inductive heating element. Preferably, the cartridge comprises a third compartment positioned between the first compartment and the second compartment, wherein the cartridge comprises a susceptor material positioned within the third compartment. During use, the controller controls the supply of electrical power from the power supply to the inductive heating element to inductively heat the susceptor material, which then heats the first compartment and the second compartment.

The inductive heating element may comprise at least one induction coil extending around at least a portion of the device cavity. The induction coil may extend completely around the device cavity. The induction coil may be wound around the device cavity with a plurality of windings.

The inductive heating element may comprise at least one planar induction coil. Preferably, each planar induction coil comprises a flat spiral induction coil.

As used herein a "flat spiral induction coil" means a coil that is generally planar, wherein the axis of winding of the coil is normal to the surface in which the coil lies. In some embodiments, the flat spiral coil may be planar in the sense that it lies in a flat Euclidean plane. However, the term "flat spiral induction coil" as used herein covers coils that are shaped to conform to a curved plane or other three dimensional surface. For example, a flat spiral coil may be shaped to conform to a cylindrical housing or cavity of the device. The flat spiral coil can then be said to be planar but conforming to a cylindrical plane, with the axis of winding of the coil normal to the cylindrical plane at the centre of the coil. If the flat spiral coil conforms to a cylindrical plane or non-Euclidian plane, preferably, the flat spiral coil lies in a plane having a radius of curvature in the region of the flat spiral coil greater than a diameter of the flat spiral coil.

In embodiments in which the cartridge comprises a third compartment, preferably the third compartment has an open upstream end and a closed downstream end.

The power supply may be a battery, such as a rechargeable lithium ion battery. Alternatively, the power supply may be another form of charge storage device such as a capacitor. The power supply may require recharging. The power supply may have a capacity that allows for the storage of enough energy for one or more uses of the device. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations.

FIG. 1 shows an aerosol-generating system 10 according to a first embodiment of the present invention. The aerosol-generating system 10 comprises an aerosol-generating device 12 and a cartridge assembly 14. The aerosol-generating device 12 comprises a device outer housing 16, and a device inner housing 18. A plurality of device air inlets 22 extend through the device inner housing 18.

Figure 2:
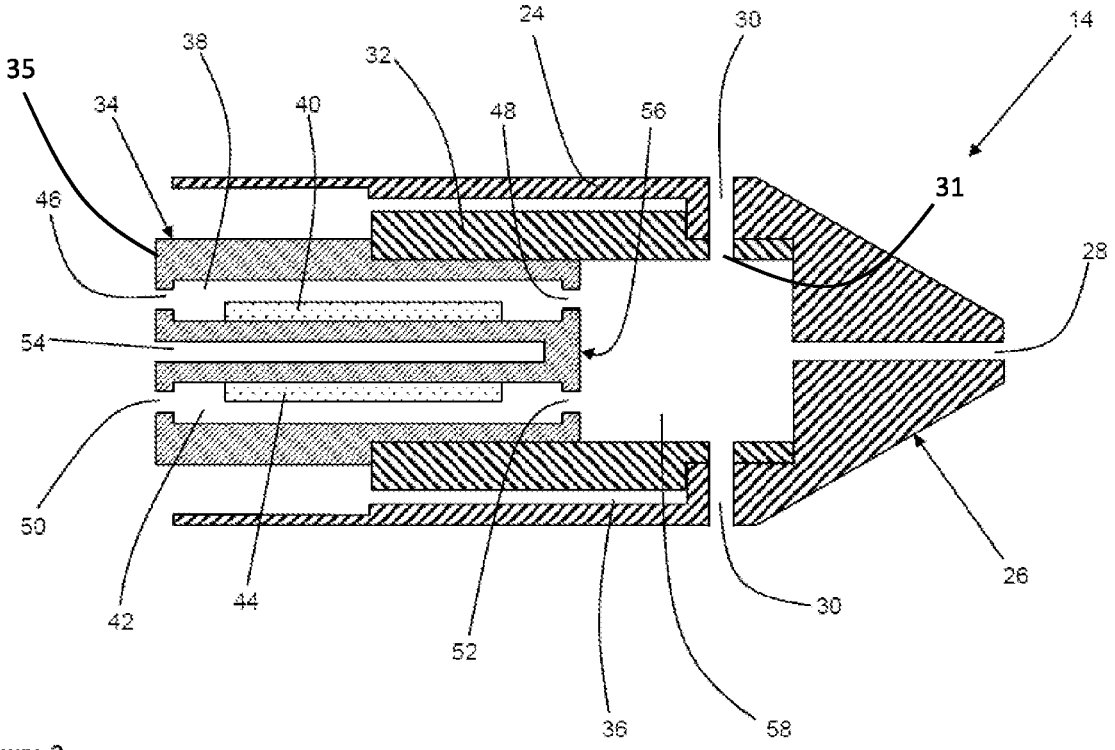
FIG. 2 shows a cross-sectional view of the cartridge assembly of the aerosol-generating system of FIG. 1.

FIG. 2 shows a schematic cross-sectional view of the cartridge assembly 14. The cartridge assembly 14 comprises a cartridge assembly outer housing 24 defining a mouthpiece 26 at its downstream end, the mouthpiece 26 comprising a mouthpiece air outlet 28. The cartridge assembly outer housing 24 also defines a plurality of ventilation air inlets 30 and underlying ventilation air apertures 31.

The cartridge assembly 14 further comprises a cartridge holder 32 and a cartridge 34. The cartridge holder 32 has a tubular shape and comprises a downstream portion that is received within the cartridge assembly outer housing 24 by an interference fit to secure the cartridge holder 32 to the cartridge assembly outer housing 24. The remainder of the cartridge holder 32 is spaced apart from the cartridge assembly outer housing 24 to form a cartridge assembly cavity 36 for receiving the device inner housing 18.

The cartridge 34 defines a first compartment 38 containing a first aerosol-forming substrate 40 and a second compartment 42 containing a second aerosol-forming substrate 44. The first aerosol-forming substrate 40 comprises a nicotine source and the second aerosol-forming substrate 44 comprises an acid source. The first compartment 38 comprises a first air inlet 46 and a first air outlet 48. The second compartment 42 comprises a second air inlet 50 and a second air outlet 52. The first air inlet 46 and the second air inlet 50 are at the upstream end 35 of the cartridge 34.

The cartridge 34 also defines a third compartment 54 positioned between the first and second compartments 38, 42. A downstream end 56 of the cartridge 34 is received within the cartridge holder 32 by an interference ft. The downstream end 56 of the cartridge 34 is spaced apart from the mouthpiece air outlet 28 to define a mixing chamber 58. The ventilation air inlets 30 provide fluid communication between an exterior of the cartridge assembly 14 and the mixing chamber 58.

Figure 3:
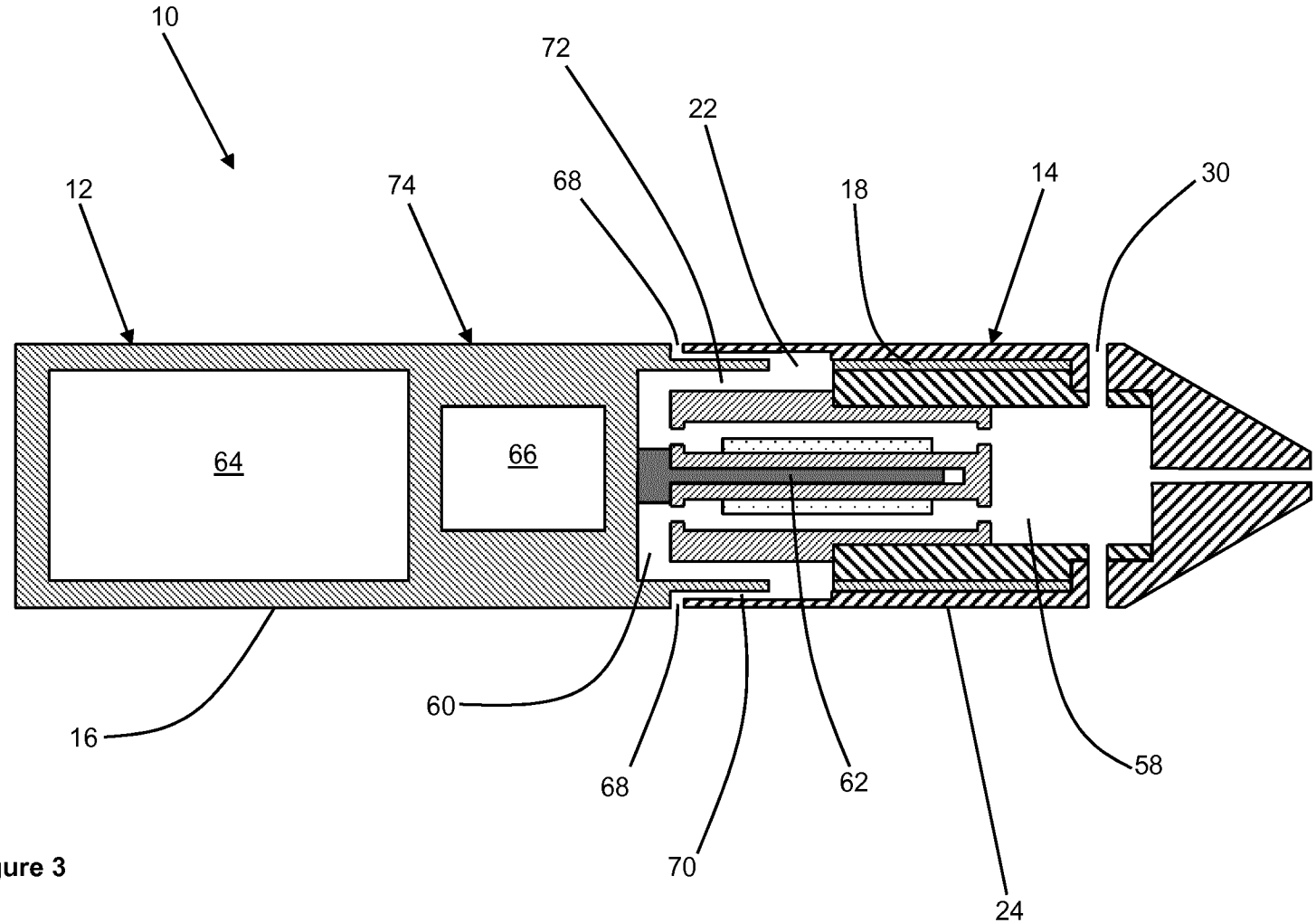
FIG. 3 shows a cross-sectional view of the aerosol-generating system of FIG. 1 with the cartridge assembly connected with the aerosol-generating device.

FIG. 3 shows a cross-sectional view of the aerosol-generating system 10 with the cartridge assembly 14 connected with the aerosol-generating device 12. When the cartridge assembly 14 is connected with the aerosol-generating device 12, an upstream end of the cartridge 34 is received within a device cavity 60 formed by the device inner housing inner housing 18, and the device inner housing 18 is received within the cartridge assembly cavity 36.

The aerosol-generating device 12 also comprise an electric heater 62, a power supply 64, and a controller 66 for controlling a supply of electrical power from the power supply 64 to the electric heater 62. The electric heater 62 is a resistive heater extending into the device cavity 60 at an upstream end of the device cavity 60. The power supply 64 is a rechargeable battery. When the upstream end of the cartridge 34 is received within the device cavity 60, the electric heater 62 is received within the third compartment 54.

When the cartridge assembly 14 is connected with the aerosol-generating device 12, a plurality of system air inlets 68 are formed between a downstream end of the device outer housing 16 and an upstream end of the cartridge assembly outer housing 24. The system air inlets 68 allow mainstream air to enter the aerosol-generating system 10. A plurality of first channels 70 provide fluid communication between each system air inlet 68 and the corresponding device air inlet 22. A plurality of second channels 72 provide fluid communication between each device air inlet 22 and the upstream end of the device cavity 60. Advantageously, mainstream air flowing through the second channels 72 is preheated as it flows over the outer surface of the cartridge 34, which is heated by the electric heater 62.

When the cartridge assembly 14 is connected with the aerosol-generating device 12, the device outer housing 16 and the cartridge assembly outer housing 24 together form a system outer housing 74.

During use of the aerosol-generating system 10, the controller 66 controls a supply of electrical power from the power supply 64 to the electric heater 62 to energize the electric heater 62. The electric heater 62 heats the first and second aerosol-forming substrates 40, 44.

When a user draws on the mouthpiece 26 mainstream air is drawn into the upstream end of the device cavity 60 via the system air inlets 68 and the device air inlets 22. The mainstream air enters the first and second compartments 38, 42 through the first and second air inlets 46, 50. As the mainstream air flows through the first and second compartments 38, 42, nicotine vapour and acid vapour from the first and second aerosol-forming substrates 40, 44 are entrained in the mainstream air. The mainstream air containing the nicotine vapour and the acid vapour flows into a mixing chamber 58 at the downstream end of the cartridge 34 where the nicotine vapour and the acid vapour react to form nicotine salt particles.

When a user draws on the mouthpiece 26, ventilation air also enters the aerosol-generating system 10. In particular, ventilation air enters the mixing chamber 58 via the ventilation air inlets 30. The cartridge holder 32 insulates the cartridge assembly outer housing 24 from the heated cartridge 34 so that the ventilation air entering the mixing chamber 58 is at a significantly lower temperature than the nicotine vapour and acid vapour entering the mixing chamber 58 from the cartridge 34.

In the mixing chamber 58, the ventilation air mixes with the nicotine salt particles formed from the nicotine vapour and the acid vapour to form an aerosol for delivery to the user. The aerosol flows out of the mixing chamber 58 via the mouthpiece air outlet 28.

Figure 4:
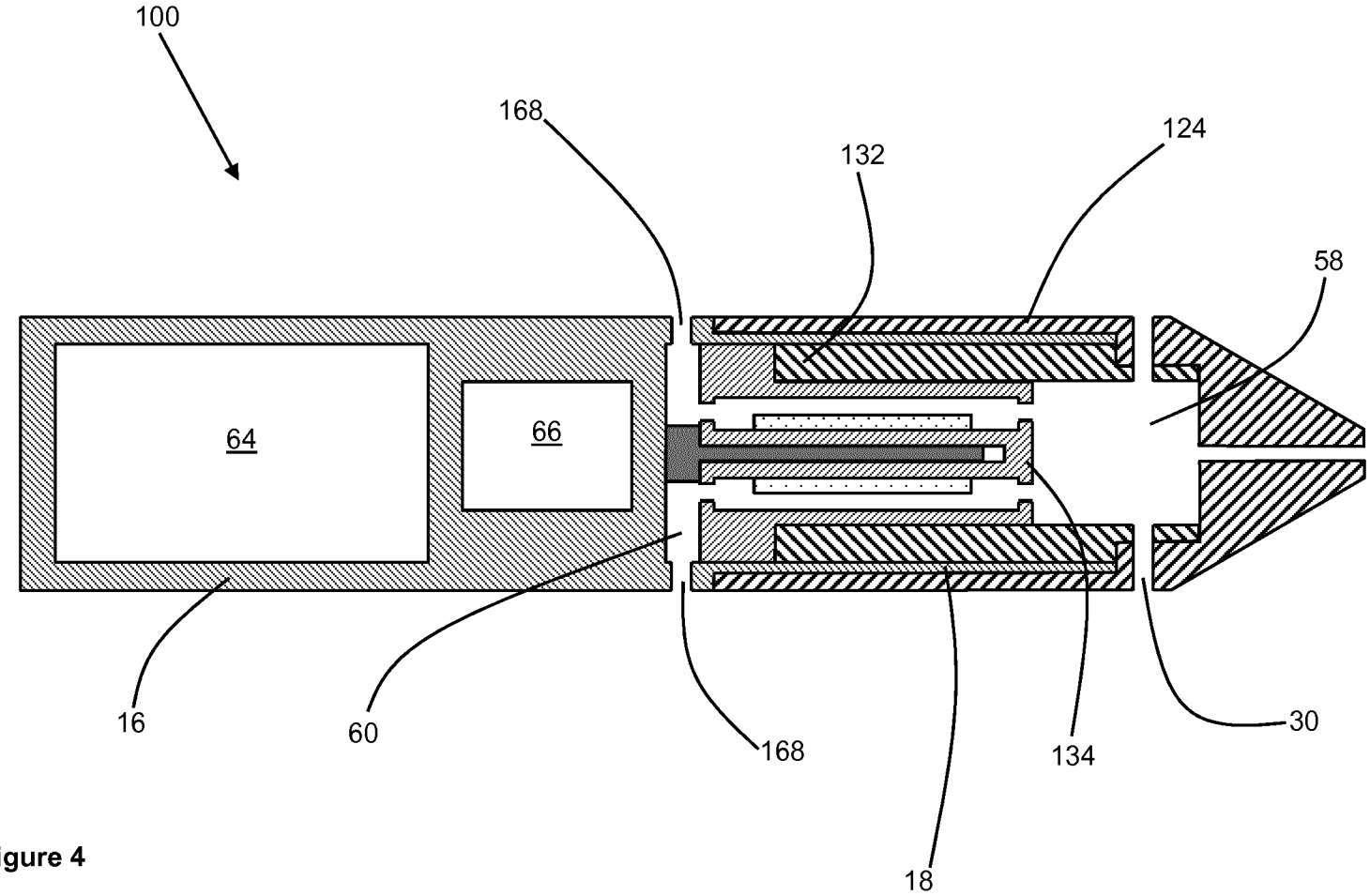
FIG. 4 shows a cross-sectional view of an aerosol-generating device according to a second embodiment of the present invention.

FIG. 4 shows a schematic cross-sectional view of an aerosol-generating system 100 according to a second embodiment of the present invention. The aerosol-generating system 100 is similar to the aerosol-generating device 10 shown in FIGS. 1 to 3, and like reference numerals are used to designate like parts.

The aerosol-generating system 100 differs from the aerosol-generating system 10 in the configuration of the system air inlets 168. Specifically, in the aerosol-generating system 100, the system air inlets 168 extend through the device outer housing 16 and provide direct fluid communication between the exterior of the aerosol-generating system 100 and the upstream end of the device cavity 60. Therefore, this configuration eliminates the need for the device air inlets 22 and the first and second channels 70, 72 provided in the aerosol-generating system 10. Advantageously, this configuration may simplify the construction of the aerosol-generating system 100. The shapes of the cartridge 134, the cartridge holder 132 and the cartridge assembly outer housing 124 are adapted to accommodate the omission of the device air inlets 22 and the first and second channels 70, 72.

The operation of the aerosol-generating system 100 is substantially the same as the operation of the aerosol-generating system 10, as described herein.

The invention claimed is:

1. An aerosol-generating system, comprising:

a cartridge assembly comprising:

a cartridge assembly outer housing at least partially defining a mouthpiece having a mouthpiece air outlet, a cartridge at least partially disposed within the cartridge assembly outer housing and having an upstream end and a downstream end, the cartridge comprising:

a first compartment having a first air inlet at the upstream end of the cartridge and a first air outlet at the downstream end of the cartridge, and a second compartment having a second air inlet at the upstream end of the cartridge and a second air outlet at the downstream end of the cartridge, a mixing chamber extending between the downstream end of the cartridge and the mouthpiece air outlet, and a ventilation air inlet extending through the cartridge assembly outer housing and disposed downstream of the cartridge, the ventilation air inlet providing fluid communication between an exterior of the aerosol-generating system and the mixing chamber; and an aerosol-generating device comprising:

a device inner housing defining a device cavity configured to receive an upstream end of the cartridge, an electrical heater configured to heat the cartridge when the upstream end of the cartridge is received within the device cavity, a power supply, a controller configured to control a supply of electrical power from the power supply to the electric heater, and a device outer housing, wherein, when the upstream end of the cartridge is received within the device cavity, at least a first part of a downstream edge of the device outer housing abuts at least a first part of an upstream edge of the cartridge assembly outer housing so that the cartridge assembly outer housing and the device outer housing form a system outer housing, and wherein the aerosol-generating system is configured so that at least a portion of the device inner housing is received between the cartridge and the cartridge assembly outer housing when the upstream end of the cartridge is received within the device cavity.

2. The aerosol-generating system according to claim 1, wherein the cartridge assembly further comprises a cartridge holder, wherein at least a portion of the cartridge is disposed within the cartridge holder, and wherein at least a portion of the cartridge holder is disposed within the cartridge assembly outer housing.

3. The aerosol-generating system according to claim 2, wherein the aerosol-generating system is further configured so that at least a portion of the device inner housing is received between the cartridge holder and the cartridge assembly outer housing when the upstream end of the cartridge is received within the device cavity.

4. The aerosol-generating system according to claim 2, wherein a downstream end of the cartridge holder is disposed upstream of the ventilation air inlet.

5. The aerosol-generating system according to claim 2, wherein a portion of the cartridge holder overlaps a portion of the cartridge assembly outer housing comprising the ventilation air inlet, and wherein the cartridge holder comprises a ventilation air aperture underlying the ventilation air inlet and configured to provide fluid communication between the ventilation air inlet and the mixing chamber.

6. The aerosol-generating system according to claim 1, further comprising a system airflow inlet extending through the system outer housing, the system airflow inlet providing fluid communication between an exterior of the aerosol-generating system and an upstream end of the device cavity, wherein the system airflow inlet is separate from the ventilation air inlet.

7. The aerosol-generating system according to claim 6, wherein, when the first part of the downstream edge of the device outer housing abuts the first part of the upstream edge of the cartridge assembly outer housing, a second part of the downstream edge of the device outer housing is spaced apart from a second part of the upstream edge of the cartridge assembly outer housing to define the system airflow inlet between the second part of the downstream edge of the device outer housing and the second part of the upstream edge of the cartridge assembly outer housing.

8. The aerosol-generating system according to claim 7, further comprising a device air inlet extending through the device inner housing, the device air inlet providing fluid communication between the system airflow inlet and an upstream end of the device cavity.

9. The aerosol-generating system according to claim 8, wherein an upstream portion of the cartridge assembly outer housing is spaced apart from the device inner housing to form a first airflow channel extending between the system airflow inlet and the device air inlet.

10. The aerosol-generating system according to claim 9, wherein a portion of the device inner housing is spaced apart from a surface of the cartridge to form a second airflow channel extending between the device air inlet and the upstream end of the device cavity.

11. The aerosol-generating system according to claim 10, wherein the device air inlet is disposed adjacent to the cartridge so that at least a portion of the second airflow channel extends parallel with the cartridge.

12. The aerosol-generating system according to claim 6, wherein the system airflow inlet extends through the device outer housing.

13. The aerosol-generating system according to claim 1, wherein the first compartment contains a nicotine source and the second compartment contains an acid source.

* * * * *